US008075466B2

(12) United States Patent
Cavallari et al.

(10) Patent No.: US 8,075,466 B2
(45) Date of Patent: Dec. 13, 2011

(54) MACHINE FOR FORMING BOXES

(75) Inventors: Stefano Cavallari, Bologna (IT); Andrea Zecchini, Bologna (IT)

(73) Assignee: CT Pack S.r.l. (IT)

( * ) Notice: Subject to any disclaimer, the term of this patent is extended or adjusted under 35 U.S.C. 154(b) by 116 days.

(21) Appl. No.: 12/453,712

(22) Filed: May 20, 2009

(65) Prior Publication Data

US 2009/0291815 A1 Nov. 26, 2009

(30) Foreign Application Priority Data

May 26, 2008 (IT) ..... BO2008A0334

(51) Int. Cl.
*B31B 1/90* (2006.01)

(52) U.S. Cl. ..... 493/105; 493/173; 493/175; 493/51

(58) Field of Classification Search ..... 493/105, 493/173, 175, 174, 51, 52, 68, 79, 107
See application file for complete search history.

(56) References Cited

U.S. PATENT DOCUMENTS 1,887,211 A * 11/1932 Mortimer ..... 198/471.1
3,439,590 A * 4/1969 Crafton et al. ..... 493/107
3,910,169 A * 10/1975 Coburn et al. ..... 493/105
3,990,353 A * 11/1976 Richards et al. ..... 493/108
4,194,440 A * 3/1980 Gorig ..... 493/105
4,409,045 A * 10/1983 Busse ..... 156/69
5,135,462 A * 8/1992 Stahlecker et al. ..... 493/87
5,622,025 A * 4/1997 Kitagawa et al. ..... 53/53
5,829,228 A * 11/1998 Mogard ..... 53/412

* cited by examiner

*Primary Examiner* — Sameh H. Tawfik
(74) *Attorney, Agent, or Firm* — Timothy J. Kilma; Shuttleworth & Ingersoll, PLC

(57) ABSTRACT

A machine for forming boxes which have at least a main body with the possibility of also having a lid hinged to it, from flat blanks, comprises a carousel (4) rotating about its own axis of rotation (4*a*), a plurality of pick up and transfer arms (5) mounted radially on the carousel (4) and able to rotate with it about the axis of rotation (4*a*) and a plurality of operating stations (6, 8, 9, 10) positioned along a circular path (P) described by the arms (5). The operating stations comprise at least a pick up station (6) for the blanks (3), a gumming station (8), a folding station (9) and a station (10) for releasing the at least partly formed boxes. Each arm (5) comprises a pick up element (11) able to slide radially away from the carousel (4) to pick up the blank (3) directly from the pick up station (6) and to accompany the box (2) as far as a supporting surface (15) at the releasing station (10).

11 Claims, 5 Drawing Sheets

MACHINE FOR FORMING BOXES

BACKGROUND OF THE INVENTION

The present invention relates to a machine for forming boxes from flat blanks, and in particular boxes which have at least a main containment body and if necessary a lid hinged to it.

The present invention is advantageously applied in lines for packaging products in general, for example for making boxes containing ice creams, snacks or any other type of products intended for sale.

The plants which manage such packaging lines comprise, connected to and operating in conjunction with each other, a machine which forms the boxes, that is to say, applies gum to several portions of the cardboard blanks and folds the blanks, a filling unit which feeds products into the boxes and a unit for closing and sealing the boxes containing the products.

The above-mentioned boxes, substantially have the shape of a parallelepiped and are obtained by means of a sequence of folding operations, from flat blanks made of stiff card material divided into a plurality of panels by creasing lines.

The above-mentioned blanks are stacked in a magazine, normally having a tilted axis, to facilitate extraction of the individual blanks from its base by suitable pick up means and the subsequent transfer to a forming unit with intermittent rotation about a horizontal axis.

The rotary forming unit comprises a cylindrical body supporting a plurality of radial arms separated from each other by equal angles, each comprising a supporting bar whose free end bears a mandrel substantially having the shape of a parallelepiped which acts as a die for forming the box-shaped body.

At least the outer wall of the mandrel, transversal to the axis of the bar supporting the mandrel and facing towards the blanks, has suction holes made in it for retaining the blank during rotation of the cylindrical body.

As the cylindrical body rotates, each arm in sequence stops at a first, loading station, at the pick up means, which comprise a pair of arms with suction cup elements oscillating about an axis parallel with the axis of the forming unit and of the cylindrical body, between the base of the magazine to pick up a blank and the mandrel suction wall, to which the blank is transferred.

For example, after a 120° rotation and gumming of predetermined zones of the blank, the mandrel supporting the blank stops at a second station, for folding, in which a folding counter-mandrel is drawn near to and couples with the mandrel, in such a way that the blank is folded about the mandrel and the main body for containing products is formed on the latter.

At a third station where the mandrel stops, for releasing, after a further rotation for example through 120°, the box-shaped body, with the open lid hinged to the main body, is removed from the mandrel by cutting off the suction applied by the mandrel suction wall and gravity causes it to drop onto a conveyor which feeds each box one after another to the above-mentioned filling unit and from there to the closing and sealing unit.

During the box forming step it is important that the blank is precisely positioned on the mandrel so that it is correctly folded along the creasing lines.

Moreover, the final, releasing step also requires a certain precision, to allow the conveyor to transfer the box to the filling unit and to correctly align it with that unit for easy, correct and rapid box filling.

In prior art plants of the type described, in particular at high production speeds there is an obvious worsening in the quality of the cardboard box.

The cause of that disadvantage may be attributed, first, to the incorrect position, which is also not strictly constant with the passage of time, adopted by the blanks relative to the folding mandrel after the operation performed by the pick up means.

The oscillating arm which extracts the blank from the magazine is synchronized with the movement of the mandrel to which the blank is transferred: however, at high speeds small phase displacements may occur between the two moving parts or slight misalignments between the blank and the mandrel, in particular at the moment when the blank passes from the oscillating arm to the mandrel.

This imprecision in the coupling between the blank and the mandrel affects the subsequent gumming steps, sometimes causing glue dribbling or incorrect gumming of the flaps of the blank, and affects the folding step, causing folds along lines other than the creasing lines.

Moreover, the box is released by the mandrel at a height of a few centimeters above the supporting surface, meaning that the box performs a small jump. This difference in height may cause incorrect positioning of the box relative to the supporting surface, preventing precise control of the exact position of the box on the conveyor.

SUMMARY OF THE INVENTION

The present invention has for an aim to provide a machine for forming boxes which is free of the disadvantages of the prior art described above.

In particular, the present invention has for an aim to propose a machine for forming boxes which is able to constantly and precisely control the position first of the blank and then of the box during the various steps of the box forming process, to guarantee the high quality of the boxes fed out of the whole packaging line management plant.

Accordingly, the present invention proposes a machine for forming boxes with features as described herein.

BRIEF DESCRIPTION OF THE DRAWINGS

The present invention is described below with reference to the accompanying drawings, which illustrate a non-limiting embodiment, in which.

DESCRIPTION OF THE PREFERRED EMBODIMENTS

Figure 1A:
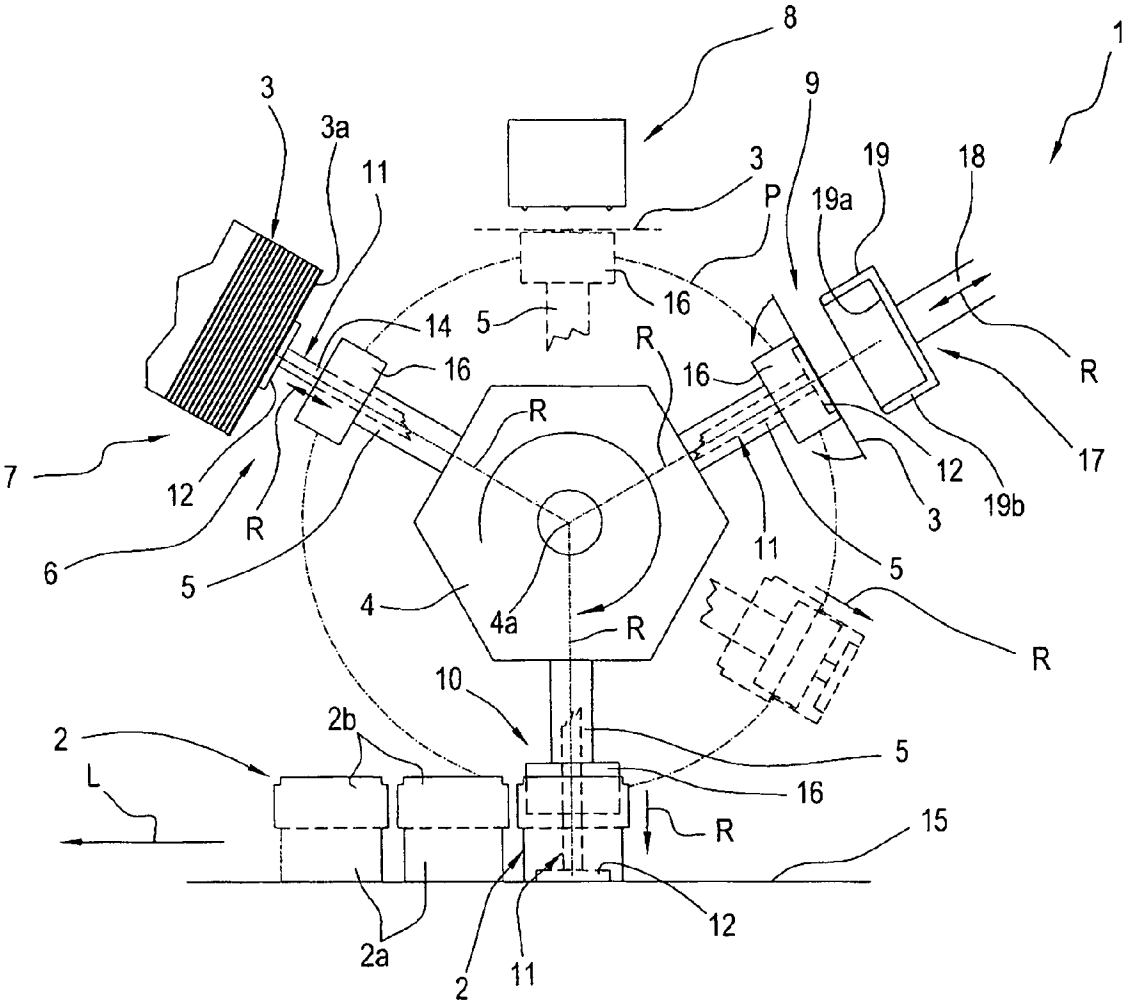
FIG. 1*a* is a schematic front view, partly in cross-section, of a machine for forming boxes according to a preferred embodiment of the present invention.
Figure 1B:
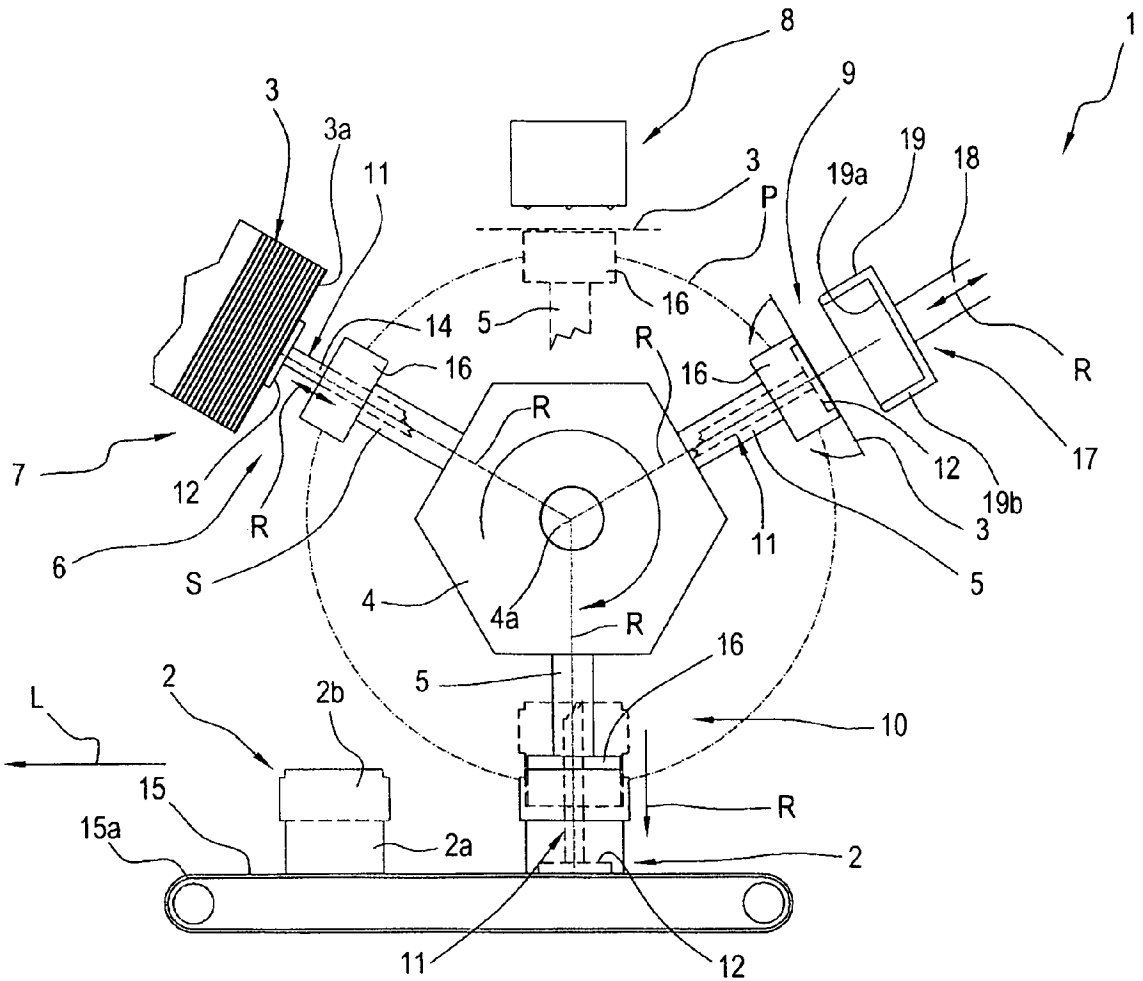
FIG. 1*b* is a schematic front view, partly in cross-section, of a machine for forming boxes according to an alternative embodiment of the present invention.

With reference to FIGS. 1*a* and 1*b*, the numeral 1 denotes as a whole a machine for forming boxes 2 which consist of a main body 2*a* and a lid 2*b* hinged to it.

The boxes 2 are made from flat blanks 3, preferably made of cardboard, and are intended to contain any kind of products, for example, but without being an exhaustive list:

snacks, ice creams, foodstuffs in general and/or convenience goods, accessories, spare parts, etc.

The machine 1 comprises a carousel 4 rotating about its own axis of rotation 4*a* which is preferably horizontal.

Mounted radially on the carousel 4, the machine 1 has a plurality of pick up and transfer arms 5, which rotate with it about the axis of rotation 4*a*.

During the rotation, the arms 5 pass through a plurality of operating stations positioned around the carousel 4, along a substantially circular path P.

The operating stations comprise at least one pick up station 6 for the blanks 3 to be folded, which are fed by means of a magazine 7, only partly illustrated in FIG. 1*a*, which has a tilted axis.

The blanks 3 are contained in the magazine 7 facing each other, with one face 3*a* pointing downwards, facing towards the axis 4*a* of the carousel 4. In this way, gravity facilitates feed and extraction of the blanks 3.

Advantageously, the face 3*a* of the blanks is substantially positioned transversally relative to a carousel 4 radial direction R.

Moreover, the machine 1 comprises a gumming station 8, designed to deposit a layer of adhesive material on predetermined zones of the blank 3.

Downstream of the gumming station 8, the machine 1 has a folding station 9, where the blank is folded to shape the main body 2*a* of the box 2, but the lid 2*b* is kept open.

After the folding station 9, the partly formed box 2 passes through a releasing station 10, where it leaves the carousel 4 and is transferred, by means of suitable movement systems described below, to other units, not illustrated, located downstream and dedicated to filling and sealing the box.

The carousel 4 preferably has at least three arms 5 arranged radially and separated from each other by equal angles, as illustrated in FIGS. 1*a* and 1*b*.

Figure 4:
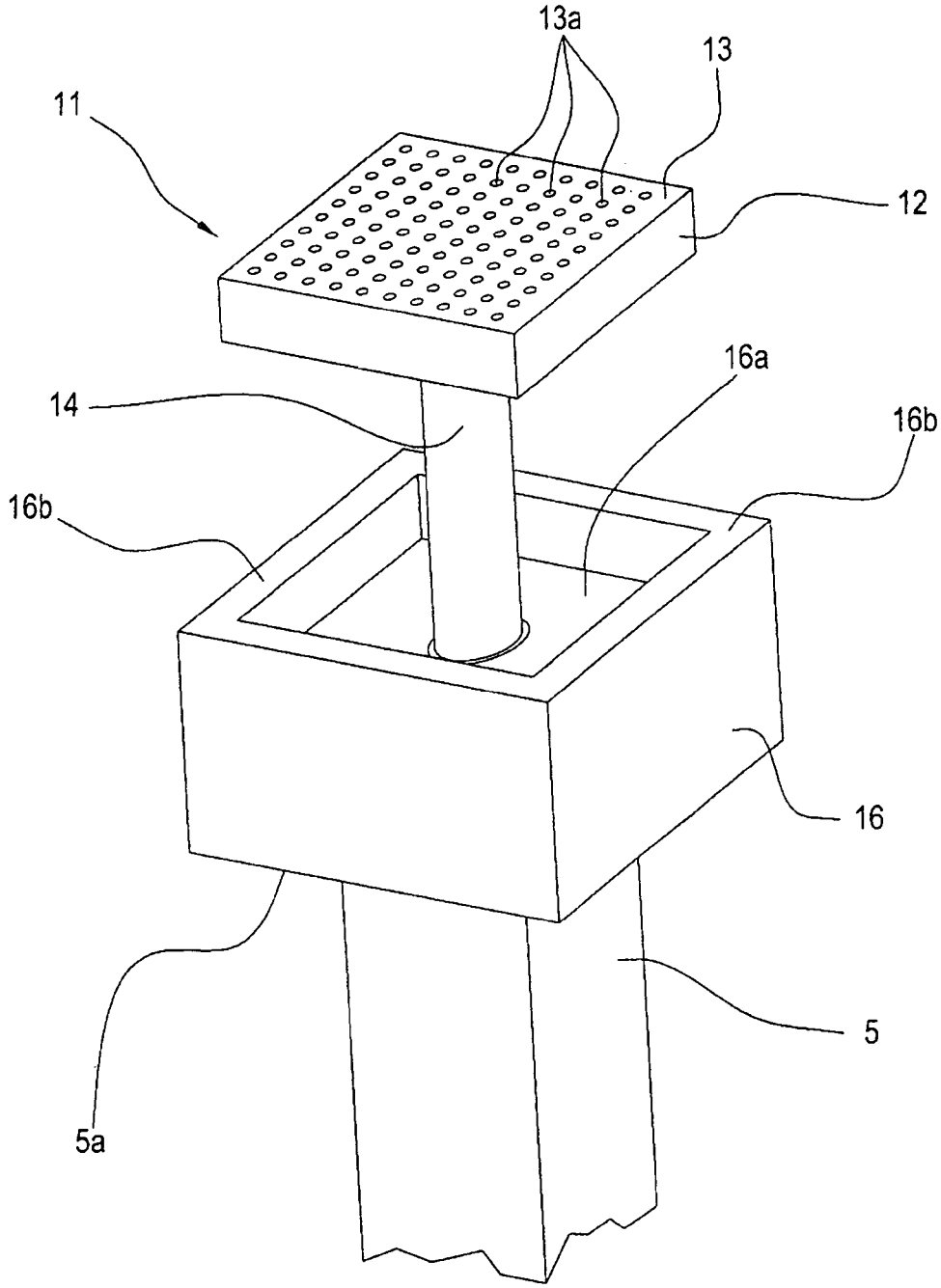
FIG. 4 is an enlarged view of a detail of the machine of FIGS. 1*a* and 1*b*.

Each arm 5 comprises a pick up element 11, illustrated in FIG. 4, able to slide in the radial direction R away from the carousel 4 or towards it, respectively to pick up the blank 3 directly from the pick up station 6 and to accompany the partly formed box 2 to a supporting surface 15 at the releasing station 10.

As FIG. 4 shows more clearly, the pick up element 11 comprises a plate 12 with a suction surface 13 and supported by a bar 14 which slides in the radial direction R inside the respective arm 5.

The suction surface 13 comprises a plurality of holes 13 or suction cups, connected to a compressed air system, not illustrated, able to create a slight vacuum on the surface 13 of the plate 12, allowing the blank 3 to be extracted from the magazine 7 then held along the transfer path P, from the pick up station 6 to the releasing station 10.

At the releasing station, the suction is cut off only when the box 2 is completely in contact with a releasing station 10 horizontal supporting surface 15.

Each arm 5 supports, at a free end 5*a*, a male forming element or die 16, preferably having the shape of a parallelepiped, against one face of which the blank 3 rests during transfer from the pick up station 6 to the releasing station 10 and around which the blank 3 is at least partly folded to form the main body 2*a* of the box 2.

The pick up element 11 is coaxial with the die 16, inside which it is housed during blank 3 transfer from the pick up station 6 to the folding station 9.

In other words, the die 16 has a cavity 16*a* in which the plate 12 is fully contained during rotation from the pick up station 6 to the folding station 9, so that the suction surface 13 is flush with an outer upper edge 16*b* of the die 16, facing away from the axis 4*a* of the carousel 4.

At the pick up station 6 the pick up element 11, and in particular the plate 12, comes out of the die 16, pushed by the bar 14 which slides out in the radial direction R, relative to the axis 4*a* of the carousel 4. In this way, it is the pick up element 11 which directly picks up the blank 3 from the magazine 7, coupling with the blank 3 in a precise predetermined and controlled position.

Similarly, at the releasing station 10, the pick up element 11 comes out of the die 16 to guide and accompany the box 2 until the box is resting on the releasing station 10 supporting surface 15.

In the preferred configuration illustrated in FIG. 1*a*, the pick up element 11 begins sliding towards the outside of the die 16 immediately downstream of the folding station 9, making the box 2 follow the curved trajectory C (FIGS. 2 and 3), not coinciding with the circular path P, between the folding station 9 and the releasing station 10.

In the preferred configuration the releasing station 10 horizontal supporting surface 15 is preferably fixed. Once placed on that surface 15, the box 2 is moved forward by the thrust from the following box 2. In order to place one box 2 alongside another and allow the boxes already released to be fed forward, without the box already present on the surface 15 obstructing the feeding of the box in arrival, the box 2 must be removed from the die 16 during the rotation from the folding station 9 to the releasing station 10. For that reason, the combination of straight motion in the radial direction provided by the thrust from the pick up element 11 with the circular motion about the axis 4*a* provided by the arm 5, causes the box 2 to follow the curved trajectory C, which from the folding station 9 arrives at a tangent to the horizontal supporting surface 15.

It should be noticed that the supporting surface cannot be at a tangent directly to the circular path P described by the arms 5, otherwise the box 2 could not be removed from the die 16.

Once released on the supporting surface 15, the boxes 2 are fed along a straight trajectory L, at a right angle to the axis of rotation 4*a* of the carousel 4 and parallel with a tangent to the circular path P.

The boxes 2, aligned in this way, feed a subsequent processing unit, if necessary channeled in suitable guides, or picked up directly by the downstream unit.

An alternative configuration, illustrated in FIG. 1*b*, has, in place of the fixed supporting surface 15, a mobile one, for example a conveyor belt 15*a*.

The latter is preferable for high speed processing.

In this configuration, the box 2 does not have to be removed from the die 16 during the transfer from the folding station 9 to the releasing station 10. Once the arm 5 is at the releasing station 10, the pick up element 11 moves in the external radial direction relative to the carousel 4, removing the box from the die 16, until the box rests on the conveyor belt 15*a* supporting surface 15.

At that moment the suction is switched off and the box 2 is definitively uncoupled from the arm 5. The conveyor belt 15*a* feeds the boxes 2 one after another along the horizontal straight trajectory L, at a right angle to the axis of rotation 4*a* of the carousel 4.

In both configurations, the boxes 2 are fed out of the machine 1 in a direction at a tangent to the circular path P of the carousel 4, thus allowing improved connection to the downstream operating units.

The pick up station 6, folding station 9 and releasing station 10 are preferably separated by equal angles along the circular path P, in such a way that they are spaced at angular intervals of 120° from each other.

In contrast, the gumming station 8 is interposed between the pick up station 6 and the folding station 9.

The folding station 9 comprises a female forming element or matrix 17, shaped to match the die 16 and positioned along a radial direction R, facing towards the arm 5.

The matrix 17 comprises a supporting rod 18 and a substantially box-shaped body 19, supported by the rod 18, having a bottom wall 19*a* and four lateral shoulders 19*b* extending away from the bottom wall 19*a*, towards the axis 4*a* of the carousel 4.

The matrix 17 moves along the radial direction R of the carousel 4 towards and away from the arm 5 supporting the blank 3, to couple with the die 16 and fold the blank 3 around the die 16.

When the arm 5 supporting the blank 3 is at the folding station 9, the matrix 17 moves towards the arm 5, is placed over the die 16 and folds the blank 3 around the die 16 to shape the box 2 main body 2*a*.

After die-matrix coupling, the portions of the blank which are folded are subjected to a double rolling, that is to say, a double pressure applied by the matrix 17, one during matrix 17 forward movement and one during its backward movement.

Advantageously, in order to be able to comply with box size change-over requirements, the machine 1 may be equipped with dies 16 and matrices 17 which are interchangeable with as many dies and matrices of different sizes.

Figure 2:
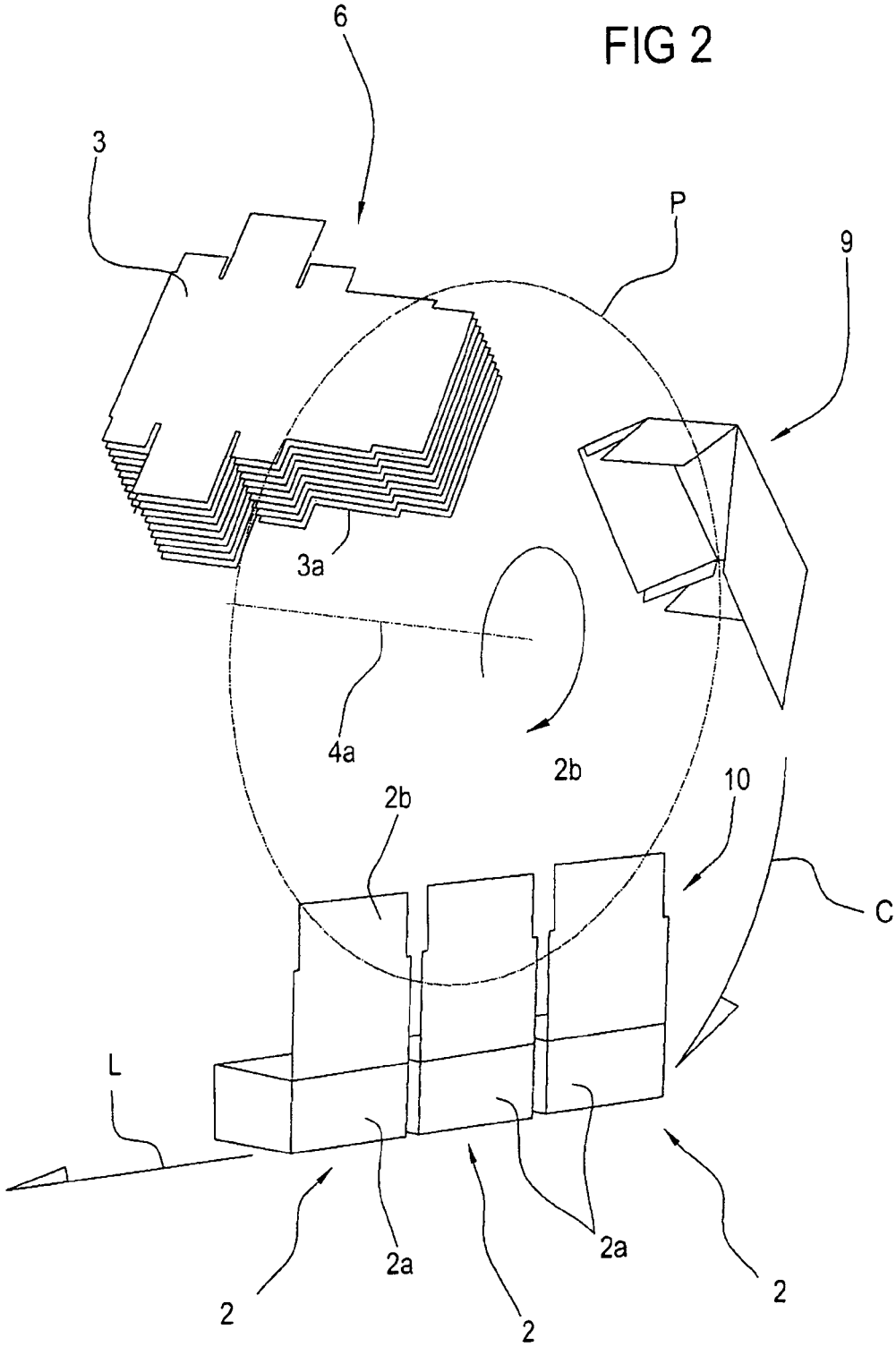
FIGS. 2 and 3 are schematic views of the box forming steps.
Figure 3:
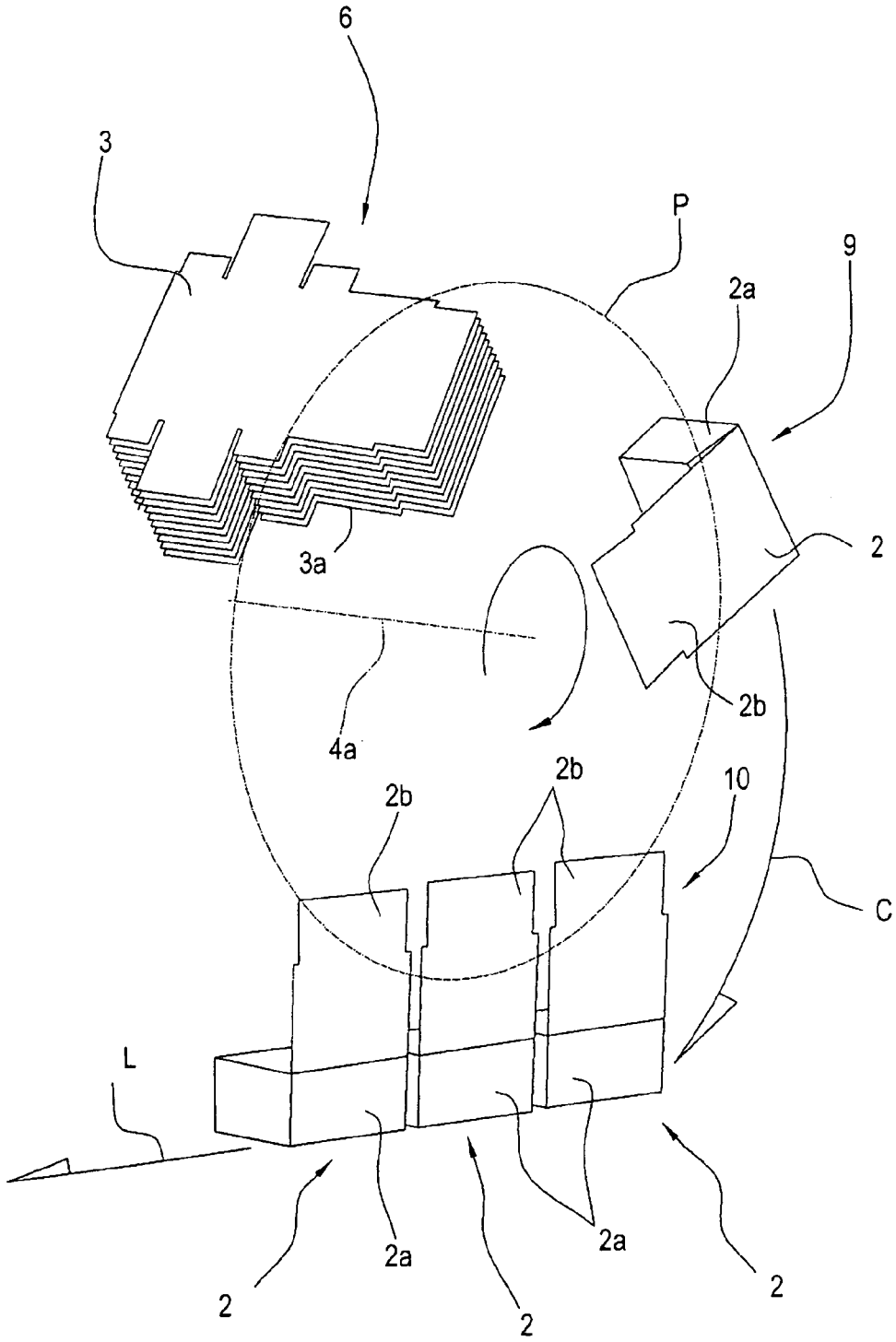

FIGS. 2 and 3 are schematic illustrations of the steps for forming the box 2 from the blank 3. The structural parts of the machine 1 are removed from those Figures to better illustrate the box 2 forming steps.

The carousel 4 rotates intermittently, preferably stopping every 120°, bringing each arm 5 to a respective station, and in particular allowing the blank 3 to be picked up from the magazine 7 and blank folding around the die 16.

In practice, as shown in FIGS. 1*a*, 1*b*, 2 and 3, the magazine 7 containing the blanks 3 stacked on top of each other is on the top left.

The carousel 4 rotates until an arm 5 is brought to the pick up station 6, where it stops for a few moments to allow the pick up element 6 to come out of the die 16 cavity 16*a* to pick up the blank 3, located in the lower part of the magazine 7, extract it from the magazine 7 and bring it into contact with the upper edge 16*b* of the die 16 when the pick up element 11 suction plate 12 returns into the die 16 cavity 16*a*.

The plate 12 couples with a central portion of the blank 3, in such a way that outer portions of the blank 3 remain projecting from the edge 16*b* of the die 16.

The carousel 4 then continues the rotation about its axis 4*a* until the arm 5, together with the blank 3 just picked up, arrives at the folding station 9 where the carousel 4 stops again for a few moments.

During the transfer from the pick up station 6 to the folding station 9 the blank passes through the gumming station 8 which applies a layer of adhesive substance on predetermined portions of the blank.

As already indicated, at the folding station 9 the matrix 17 moves forwards towards the die 16 and couples with it to fold at 90° around the die 16, towards the axis 4*a* of the carousel 4, the portions of the blank projecting from the die 16.

The gummed portions adhere to the predetermined parts of the blank to form the box 2 main body 2*a*, whilst the lid 2*b*, if present, remains open as shown in FIGS. 2 and 3. Said Figures illustrate two consecutive steps for forming the box 2 main body 2*a* at the folding station 9. FIG. 2 shows an initial moment of the step of folding the blank 3, whilst FIG. 3 shows the box 2 with the main body 2*a* already formed.

At this point, the carousel 4 continues its rotation until the arm 5, supporting the box 2, is brought to the releasing station 10, where the box 2 is placed directly on the supporting surface 15, as described above, with the lid 2*b* in the raised position. It should be noticed that during this step the arm 5, and in particular the pick up element 11, accompanies the box 2 until the box is resting on the surface 15, without making the box perform any jump.

The invention fulfils the preset aims.

The two most critical steps of the box forming process are carried out directly by the machine structural elements, which constantly accompany first the blank and then the box, without any help from intermediate elements.

The step of picking up the blank is carried out directly by the pick up element which is precisely positioned in contact with the blank, thus successfully controlling the relative position between the blank and the die along all of the processing stations.

Moreover, during the releasing step the pick up element does not release the box several centimeters from the supporting surface, instead it accompanies the box until the box is resting directly on the supporting surface. Only at that moment does the pick up element disengage from the box when the suction is switched off. Therefore, the position of the box relative to the supporting surface at the forming machine outfeed can also be constantly and precisely controlled.

In this way, a high level of quality can be guaranteed for the boxes fed out of the whole plant.

What is claimed is:

1. A machine for forming boxes which have at least a main body and the possibility of having a lid hinged to it, starting with flat blanks, comprising:

a carousel which rotates about its own axis of rotation, a plurality of pick up and transfer arms mounted radially on the carousel and rotating with it about the axis of rotation, a plurality of operating stations positioned along a circular path described by the arms; the plurality of stations comprising at least a pick up station for the blanks to be folded, a gumming station, a folding station and a station for releasing the at least partly formed boxes;

wherein each arm comprises a pick up element able to slide radially away from the carousel to pick up the blank directly from the pick up station and to accompany the box as far as a supporting surface at the releasing station; each arm comprising, at a free end, a die against which the blank rests during the transfer from the pick up station to the releasing station;

wherein the folding station comprises a matrix, shaped to match the die, radially movable relative to the arm for coupling with the die and folding the blank around the die.

2. The machine according to claim 1, wherein the pick up element is contained in the die, from which it comes out, sliding out in a radial direction, at the pick up station and at the releasing station.

3. The machine according to claim 1, wherein the pick up element is contained in the die, from which it comes out, sliding out in a radial direction, at the pick up station and following a curved trajectory in the path between the folding station and the releasing station.

4. The machine according to claim 1, wherein the pick up element comprises a suction surface and is supported by a radial bar, the bar sliding inside the respective arm.

5. The machine according to claim 4, wherein the suction surface is switched off at the releasing station.

6. The machine according to claim 1, comprising at least three radial pick up and transfer arms separated from each other by equal angles.

7. The machine according to claim 1, wherein the pick up station, the folding station and the releasing station are separated from each other by equal angles; the gumming station being interposed between the pick up station and the folding station.

8. The machine according to claim 1, wherein the carousel rotates intermittently, stopping to allow blank pick up and folding.

9. The machine according to claim 1, wherein the pick up station comprises a magazine for feeding the blanks, the blanks being positioned with one surface transversal to a radial direction of the carousel and facing towards the axis of the carousel.

10. The machine according to claim 1, wherein the releasing station is positioned such that each box, after being placed on the supporting surface, moves away from the carousel along a straight trajectory, at a right angle to the axis of rotation of the carousel and parallel with a tangent to the circular path.

11. The machine according to claim 1, wherein each die and each matrix is interchangeable with a die and a matrix of a different size, allowing the machine to be adapted to various box sizes.

* * * * *